US007168137B1

(12) United States Patent
Oustian et al.

(10) Patent No.: US 7,168,137 B1
(45) Date of Patent: Jan. 30, 2007

(54) HANDKERCHIEF HOLDING SYSTEM

(76) Inventors: Anjela Oustian, 8204 Renfrew Dr., Las Vegas, NV (US) 89145; Evangelia Kambouris, 2828 Billy Casper, Las Vegas, NV (US) 89134

( * ) Notice: Subject to any disclaimer, the term of this patent is extended or adjusted under 35 U.S.C. 154(b) by 62 days.

(21) Appl. No.: 10/937,054

(22) Filed: Sep. 8, 2004

(51) Int. Cl.
*A45F 5/04* (2006.01)

(52) U.S. Cl. ..... 24/7

(58) Field of Classification Search ..... 24/3.1, 24/3.5, 7–9; 2/247–251
See application file for complete search history.

(56) References Cited

U.S. PATENT DOCUMENTS

| | | | | | |
|---|---|---|---|---|---|
| 217,222 | A | * | 7/1879 | Hunter | 24/3.5 |
| 485,552 | A | * | 11/1892 | Lytle | 24/3.5 |
| 721,359 | A | * | 2/1903 | Dexter | 24/3.5 |
| 1,466,993 | A | | 9/1923 | Creech | |
| 2,060,729 | A | | 11/1936 | Gilgenbach | 35/56 |
| 2,211,023 | A | * | 8/1940 | Murphy | 24/3.5 |
| 2,296,665 | A | | 9/1942 | Halter et al. | 35/56 |
| 2,379,092 | A | * | 6/1945 | Maschoff | 24/3.5 |
| 2,513,154 | A | | 6/1950 | Dundon | 2/279 |
| 2,592,033 | A | | 4/1952 | Hicks | 2/279 |
| 2,597,146 | A | * | 5/1952 | Ginal, Jr. | 24/3.5 |
| 2,778,080 | A | | 1/1957 | Kernicki | 24/3 |
| 3,063,487 | A | | 11/1962 | Mullin | 150/37 |
| 3,135,030 | A | | 6/1964 | Weber | 24/3 |
| 3,135,967 | A | * | 6/1964 | Stephens | 24/3.5 |
| 3,142,876 | A | * | 8/1964 | Roberts | 24/3.5 |
| 3,184,759 | A | | 5/1965 | Masters | 2/279 |
| 3,412,435 | A | | 11/1968 | Poppe | 24/3 |
| 3,760,459 | A | * | 9/1973 | Miles | 24/3.5 |
| 3,786,520 | A | | 1/1974 | Harmon | 2/279 |
| 4,897,900 | A | | 2/1990 | Baggett | 24/543 |
| 5,477,562 | A | * | 12/1995 | Dixon | 24/3.5 |
| 6,061,838 | A | | 5/2000 | Roffe | 2/279 |

FOREIGN PATENT DOCUMENTS

| | | |
|---|---|---|
| JP | 6313201 | 11/1994 |

* cited by examiner

*Primary Examiner*—Robert J. Sandy
*Assistant Examiner*—Ruth C. Rodriguez

(57) ABSTRACT

The present invention entails a handkerchief holding system for efficiently positioning and retaining a handkerchief within a structure. The handkerchief holding system includes a housing having at least one wall and an opening exposing an interior cavity, a spring extending about a portion of the perimeter of the housing, and a clamping apparatus extending about the opening of the housing. The housing is positionable within a shirt breast pocket for conveniently retaining a handkerchief within the breast pocket of a shirt. The clamping apparatus is capable of retaining and supporting the handkerchief in a desired partially exposed position within the pocket.

12 Claims, 10 Drawing Sheets

HANDKERCHIEF HOLDING SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to handkerchief holding devices and more specifically it relates to a handkerchief holding system for efficiently positioning and retaining a handkerchief or other object within the breast pocket of an article of clothing.

2. Description of the Related Art

Handkerchief holding devices have been in use for years. Typically, clothing items (e.g. shirts) include a pocket in which a handkerchief may be received, such as the breast pocket of a shirt or suit. When positioned within a conventional pocket of a clothing item, the handkerchief is susceptible to falling out of the pocket when a person leans over.

In addition to pockets within clothing items, other handkerchief holding devices are comprised of a separate pocket structure that includes an elastic opening or drawstring to hold the handkerchief in place. These products generally have a structure that deforms over time, requiring purchase of a new handkerchief holder. Additionally, these devices are generally suited only for holding handkerchiefs and other lightweight objects loosely within a breast pocket.

In these respects, the handkerchief holding system according to the present invention substantially departs from the conventional concepts and designs of the prior art, and in so doing provides an apparatus primarily developed for the purpose of efficiently positioning and retaining a handkerchief within a structure.

BRIEF SUMMARY OF THE INVENTION

In view of the foregoing disadvantages inherent in the known types of handkerchief holding devices now present in the prior art, the present invention provides a new handkerchief holding system construction wherein the same can be utilized for efficiently positioning and retaining a handkerchief or other object within the breast pocket of an article of clothing.

The general purpose of the present invention, which will be described subsequently in greater detail, is to provide a new handkerchief holding system that has many of the advantages of the handkerchief holding devices mentioned heretofore and many novel features that result in a new handkerchief holding system which is not anticipated, rendered obvious, suggested, or even implied by any of the prior art handkerchief holding devices, either alone or in any combination thereof.

To attain this, the present invention generally comprises a housing having at least one wall and an opening exposing an interior cavity, a spring extending about a portion of the perimeter of the housing, and a clamping apparatus extending about the opening of the housing. The housing is positionable within a shirt breast pocket for conveniently retaining a handkerchief within the breast pocket of a shirt.

The clamping apparatus is capable of retaining and supporting the handkerchief in a desired partially exposed position within the pocket.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a handkerchief holding system that will overcome the shortcomings of the prior art devices.

A second object is to provide a handkerchief holding system for efficiently positioning and retaining a handkerchief or other object within the breast pocket of an article of clothing.

Another object is to provide a handkerchief holding system that is able to maintain its original structural form after many uses.

An additional object is to provide a handkerchief holding system that is capable of retaining objects within a breast pocket of a shirt or suit.

An additional object is to provide a handkerchief holding system that is capable of supporting a handkerchief partially extended from a breast pocket in an aesthetically pleasing manner.

A further object is to provide a handkerchief holding system that is capable of being removably positioned within various types and sizes of pockets of clothing items.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
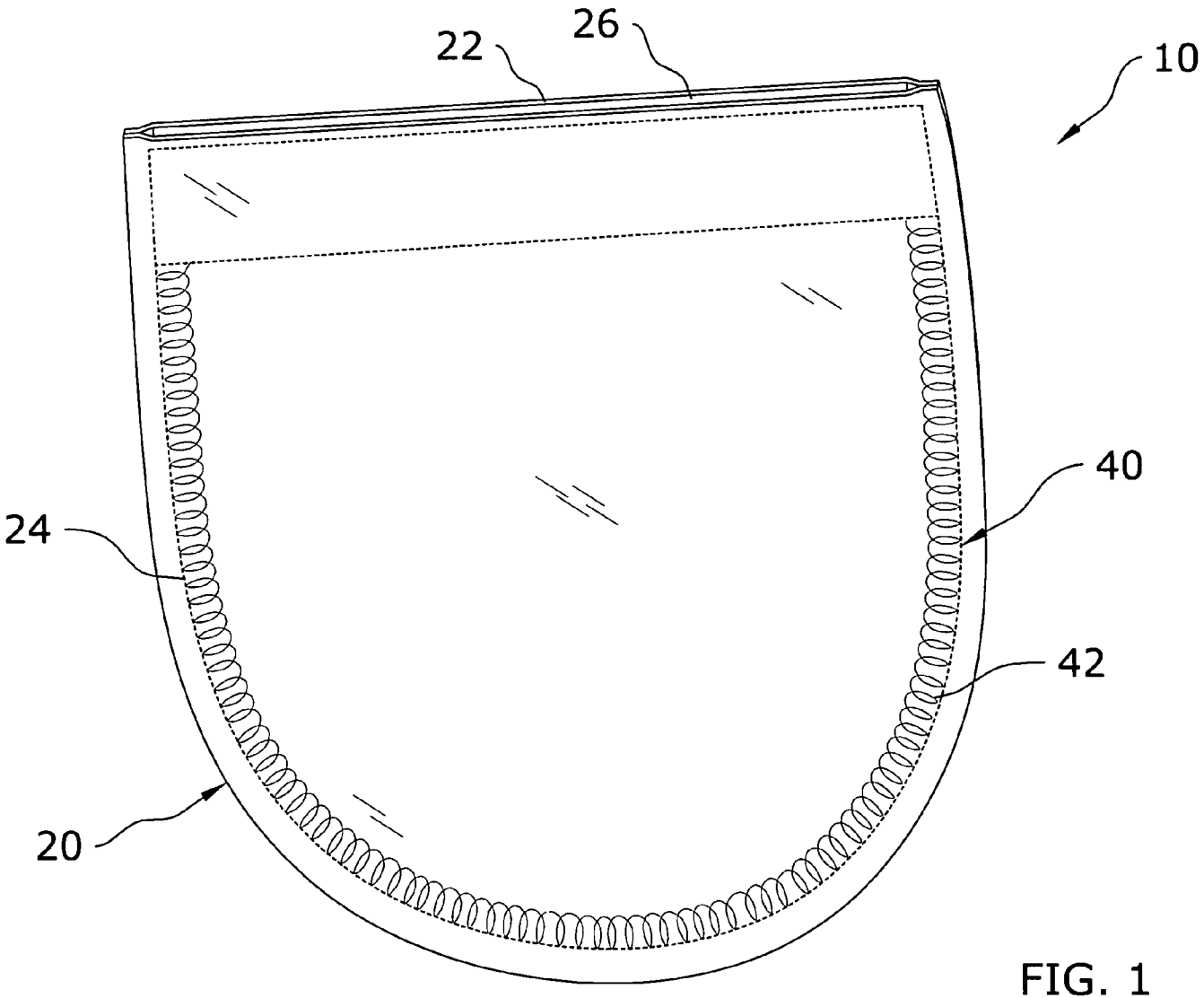
FIG. 1 is an upper perspective view of the present invention with the opening in a closed state.

Turning now descriptively to the drawings, in which similar reference characters denote similar elements throughout the several views, FIGS. 1 through 10 illustrate a handkerchief holding system 10, which comprises a handkerchief holding system 10 for efficiently positioning and retaining a handkerchief 12 or other object within the breast pocket 52 of a shirt 50 or other article of clothing. The handkerchief holding system 10 includes a housing 20 having at least one wall and an opening 26 exposing an interior cavity, a spring 40 extending about the perimeter of the housing 20 and a clamping apparatus 30 extending about the perimeter of the opening 26 of the housing 20.

B. Housing

The housing 20 preferably has at least one wall and an upper end 22 with an opening 26 exposing an inner cavity. The housing is positionable within a breast pocket 52 of a piece of clothing such as a shirt 50 as shown in FIGS. 7, 8 and 9. The housing 20 is preferably constructed by placing identical pieces of material together in a mirror image fashion, whereby the pieces are secured together by plurality of fasteners 24 preferably leaving at least one side unfastened, preferably an upper end 22 that provides an opening 26 as shown in FIGS. 1, 2, 5, 6 and 10.

Figure 4:
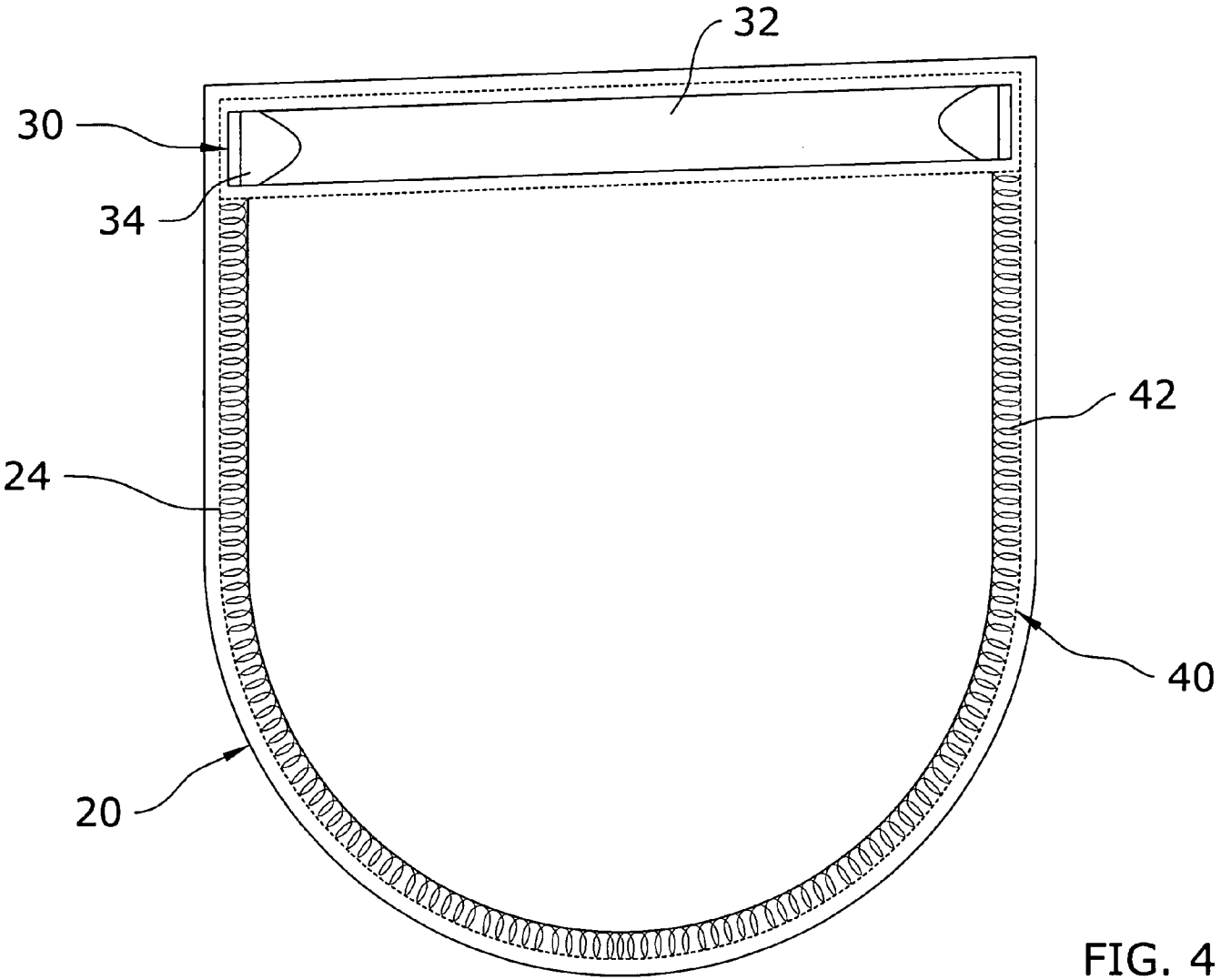
FIG. 4 is a cutaway view of the present invention illustrating the biased perimeter and the clamping apparatus.
Figure 5:
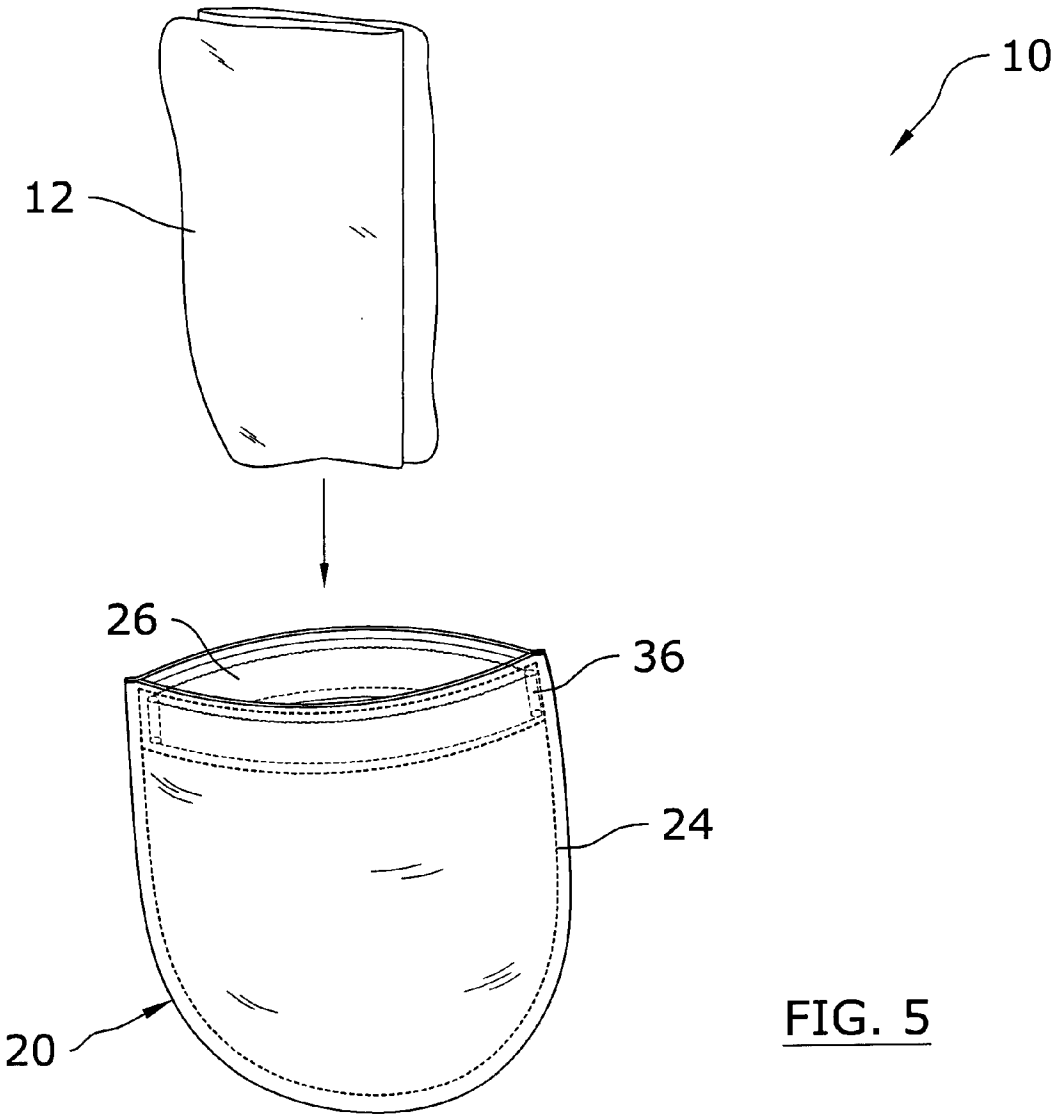
FIG. 5 is an upper perspective view of the present invention demonstrating the insertion of a handkerchief when the clamping apparatus is in the open state.
Figure 6:
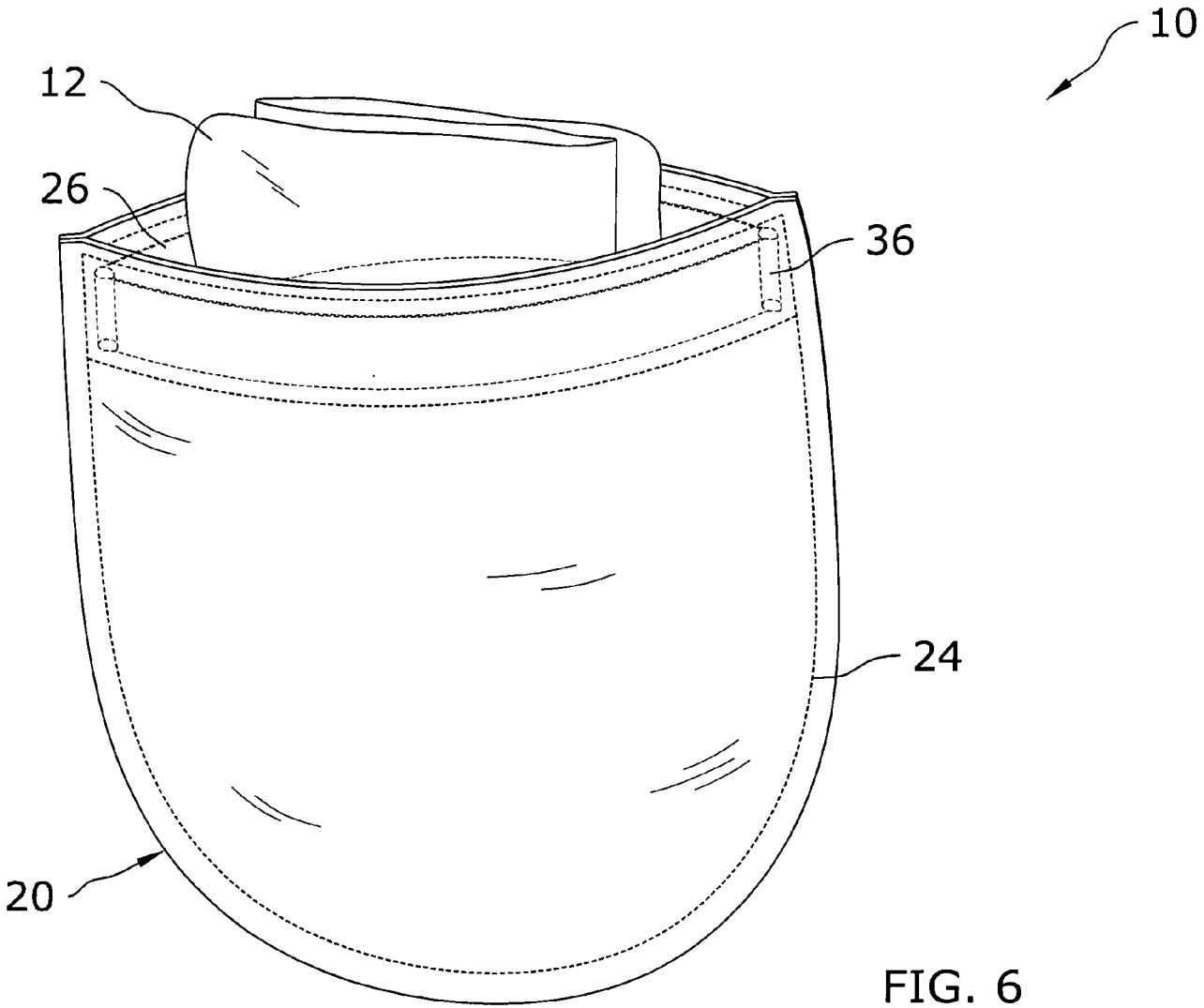
FIG. 6 is an upper perspective view of the hinges within the clamping apparatus of the present invention.
Figure 7:
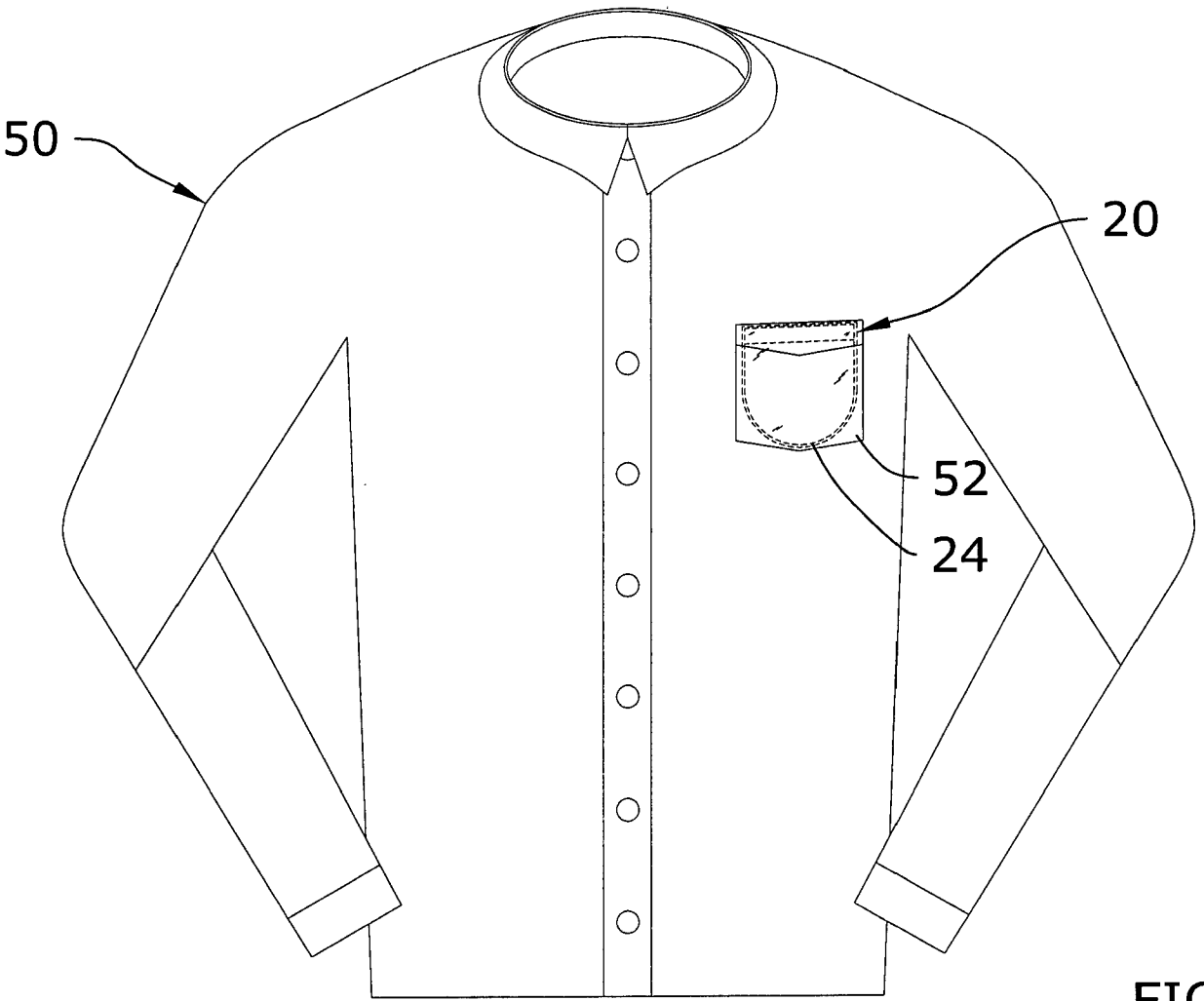
FIG. 7 is a front view of the present invention fully positioned in the breast pocket of a shirt.
Figure 8:
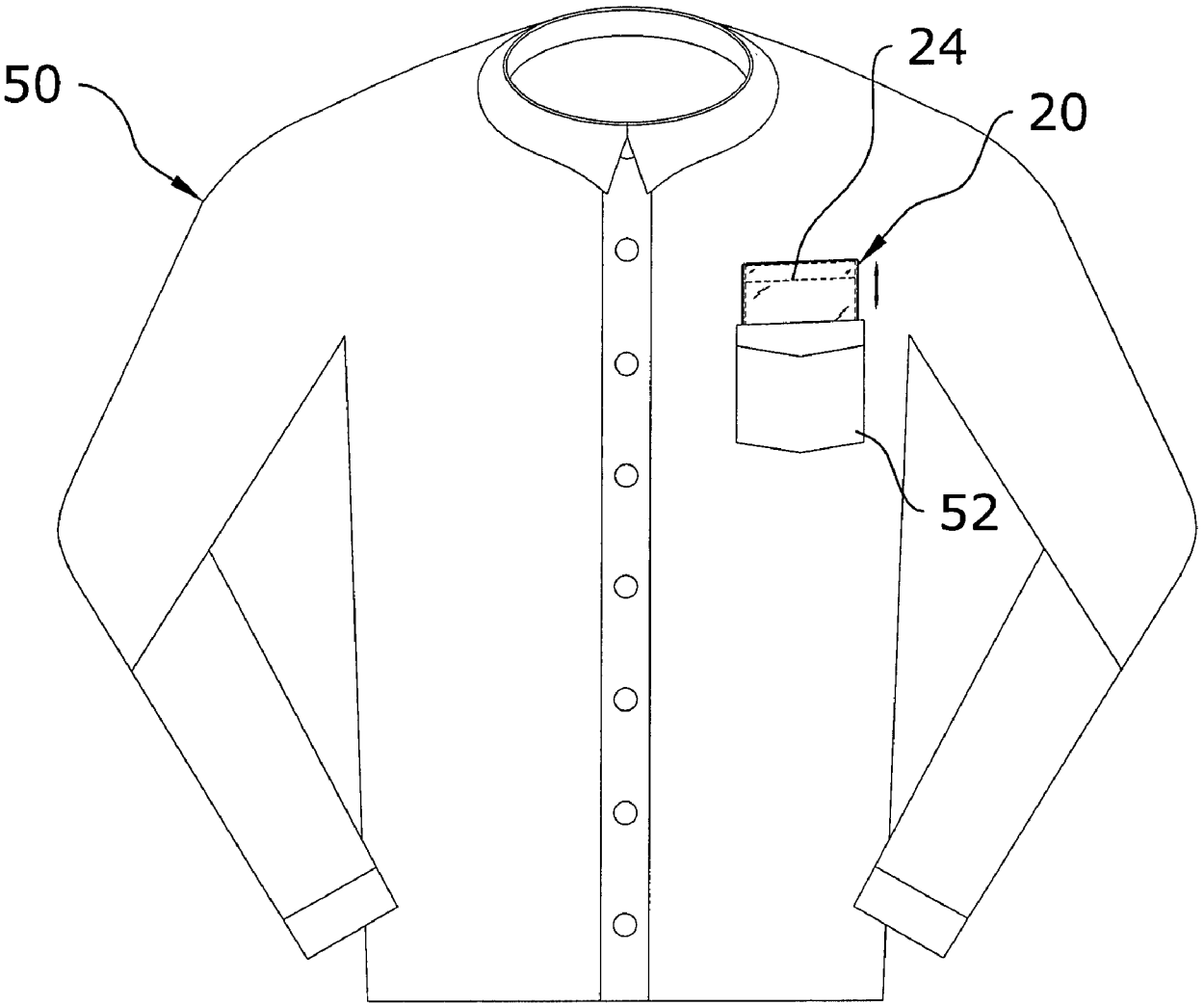
FIG. 8 is a front view of the present invention partially positioned within the breast pocket of a shirt.
Figure 9:
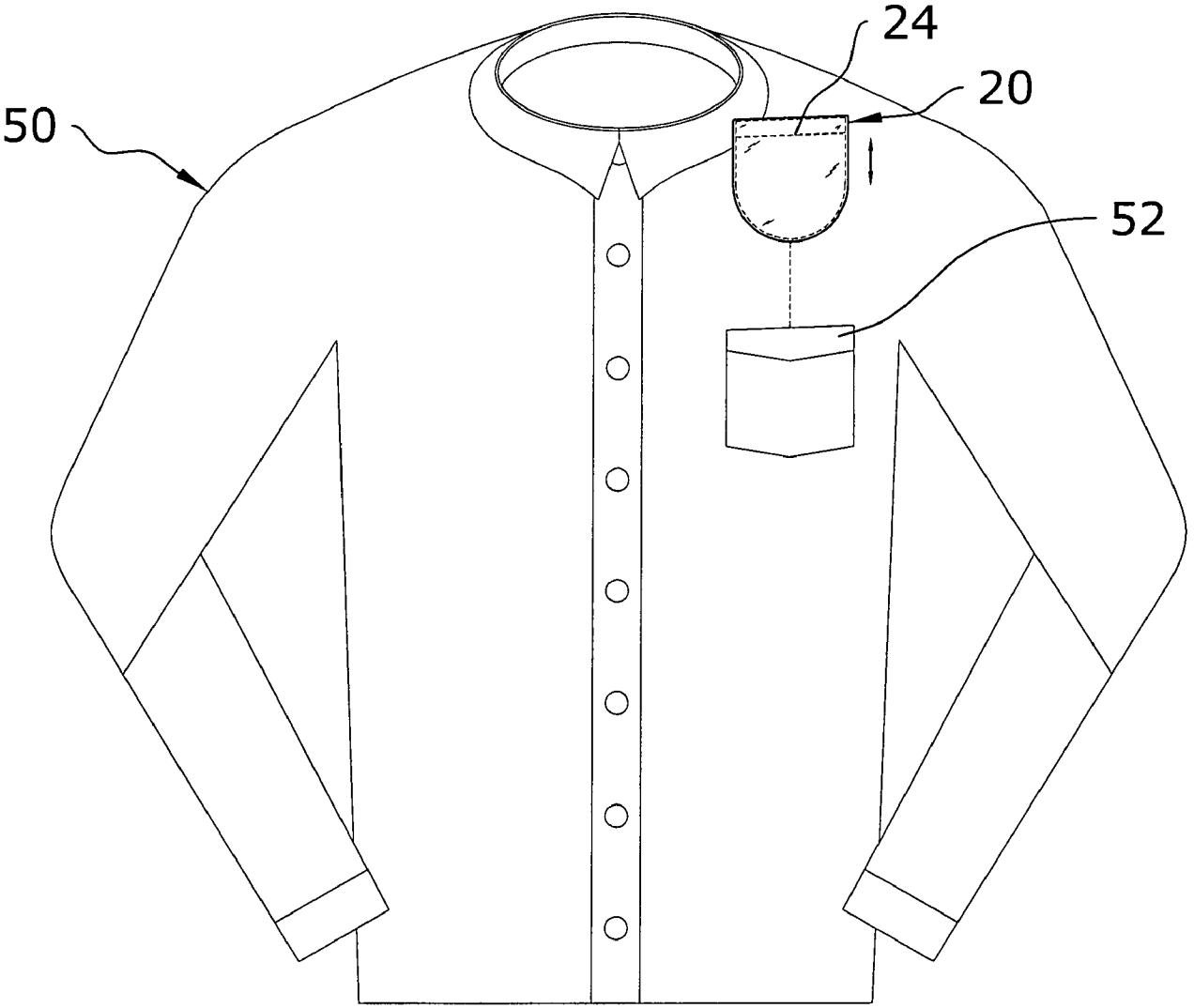
FIG. 9 is an exploded front view of the present invention with respect to a breast pocket.

In the preferred embodiment, the housing 20 would have a U-shaped structure as illustrated in FIGS. 1 through 9. As shown in FIGS. 7 through 9, the U-shaped structure allows the housing 20 to fit within a shirt pocket 52 using friction and the weight of the housing 20 to restrain the housing 20 from shifting within or falling out of the shirt pocket 52. In the preferred embodiment, the U-shaped structure of the housing 20 provides that the opening 26 on the upper end 22 of the housing 20 corresponds with the open portion of the shirt pocket 52 as illustrated in FIGS. 7 and 8. The opening 26 can thereby accommodate an object (e.g. a handkerchief 12) positionable in the pocket portion of the housing 20 and partially exposed out of the opening 26 as shown in FIG. 6.

C. Clamping Apparatus

Figure 10:
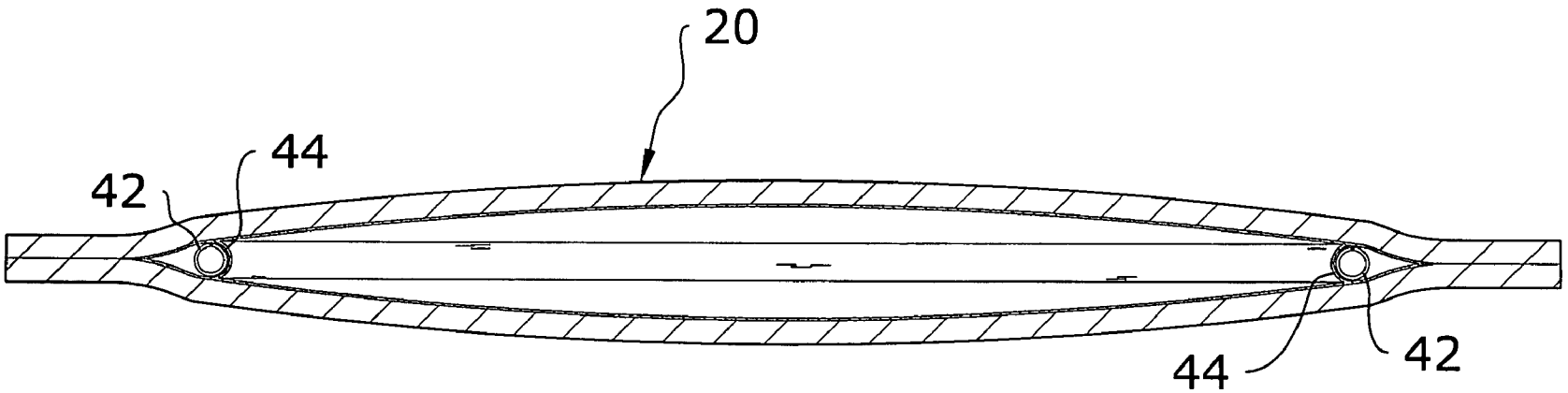
FIG. 10 is a cross-sectional view taken along line of FIG. 3.

The clamping apparatus 30 consists of clamping members 32, clamps 34 and hinges 36. The clamping members 32 extend about the inside perimeter of the opening 26 of the housing 20 as shown in FIG. 6. The clamps 34 of the clamping apparatus 30 are positioned at the ends of the clamping members 32 wherein the clamps 34 apply a bias force to the clamping members 32, pulling the clamping members 32 together causing the opening 26 to form a closed state. In the closed state, clamping members 32 form a substantially linear shape at the opening 26 as shown in FIGS. 1 and 10. The hinges 36 are attached to the clamps 34 and positioned between the clamps 34 and the fasteners 24 of the housing 20 as shown in FIGS. 5 and 6.

D. Biased Perimeter

Figure 2:
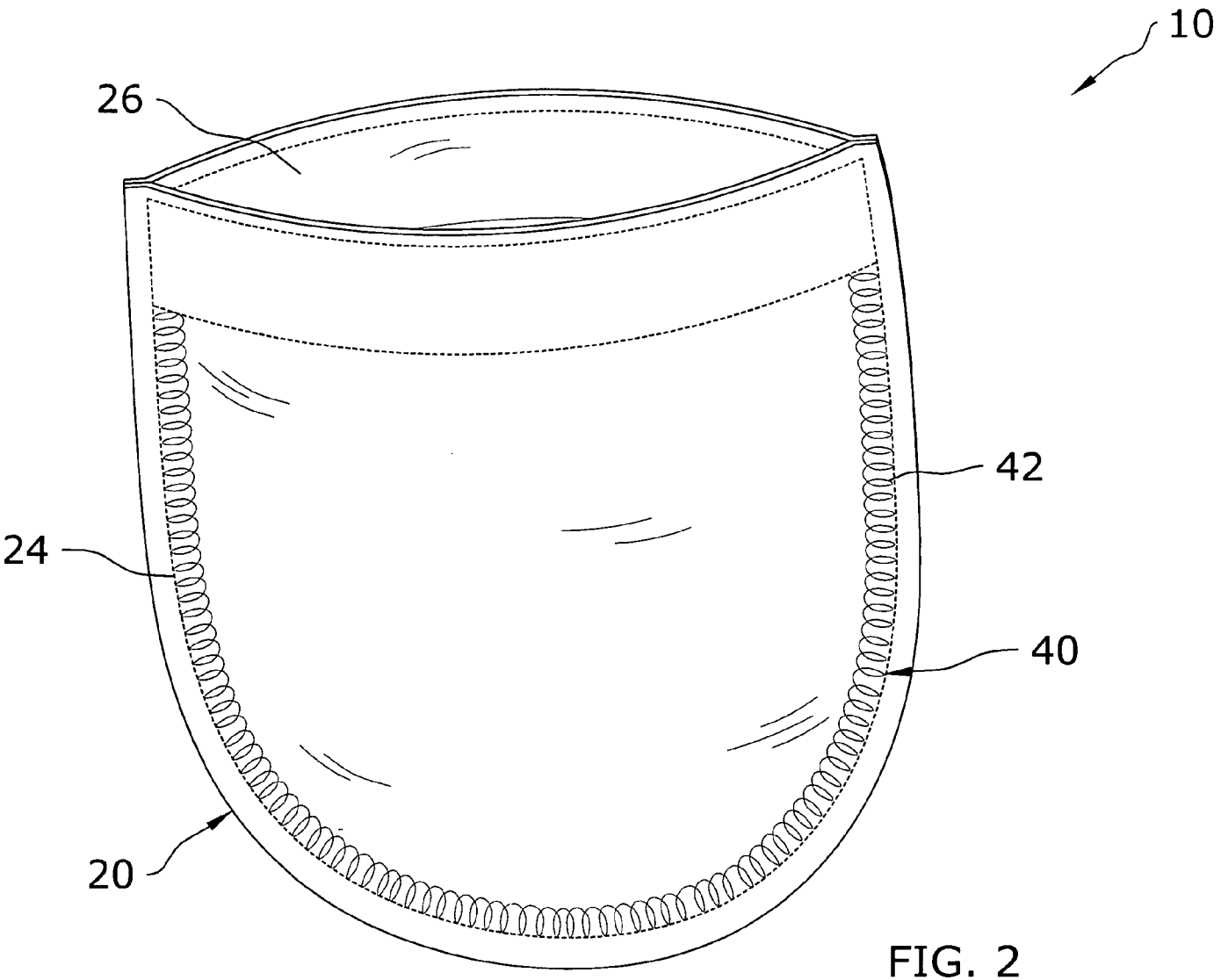
FIG. 2 is an upper perspective view of the present invention with the opening in the open state.
Figure 3:
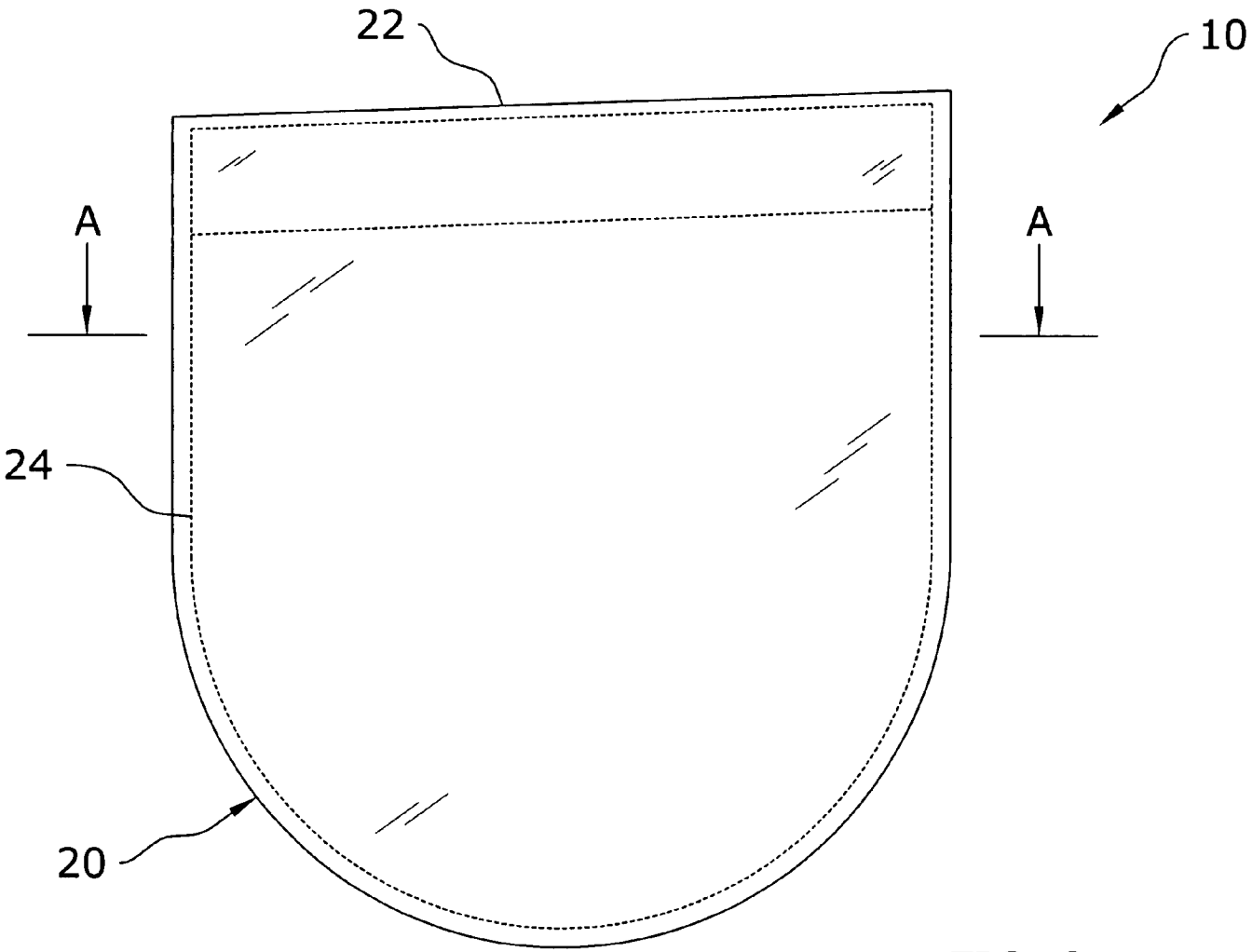
FIG. 3 is a front view of the present invention.

The biased perimeter 40 includes a spring 42 extending about a portion of the perimeter of the housing 20 as shown in FIGS. 1, 2 and 4. The spring 42 is held in place by a securing loop 44 that is wrapped around the spring 42 and secured to the fasteners 24 of the housing 20 as shown in FIG. 10. Placing the spring 42 about the perimeter of the housing 20 gives the housing 20 more stability and flexibility than material of the housing 20 would have by itself.

F. Use of Invention

In use, a user wishing to place an object within the handkerchief holding system 10 would apply pressure on the hinges 36 in the direction of the opposing hinge 36. Each hinge 36 thereby rotates about itself, overcoming the bias force of the clamps 34 and forcing the clamping members 32 to distort from their linear configuration, thereby manipulating the opening 26 from a closed state to an open state. This function can be seen in FIGS. 1 and 2.

When the open state of the opening 26 has been created, a user may insert an object into the opening 26 as shown in FIG. 5. If the object is small enough to fit entirely within the pocket of the housing 20, the user may release the pressure on the hinges 36, whereby the bias of the clamps 34 causes the clamping members 32 to return to the substantially linear closed state, thereby enclosing the object within the housing 20 as shown in FIG. 1. If the object is too large to fit entirely into the pocket of the housing 20, the user may insert the object into the opening 26 to a desired depth within the pocket of the housing 20. Upon releasing the pressure on the hinges 36, the bias of the clamps 34 move one clamping member 32 toward the opposing clamping member 32. This inward force lodges the object in the opening 26, thereby turning the opening 26 into a securing member as shown in FIG. 6. After inserting the object (e.g. handkerchief 12) into a desired configuration within the housing 20, the user would preferably place the housing 20 within the breast pocket 52 of an article of clothing.

To remove the object from the handkerchief holding system 10, a user need only apply a force to the hinges 36 to re-distort the clamping members 32 to form the open state of the opening 26. The user may then remove any object from the pocket of the housing 20 or from an object that was lodged between the clamping members 32 of the opening 26. Upon removal of the object, releasing the pressure on the hinges 36 allows the clamping members 32 to return to their preferred linear shape and the opening 26 returns to a closed state as shown in FIG. 1.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims (and their equivalents) in which all terms are meant in their broadest reasonable sense unless otherwise indicated. Any headings utilized within the description are for convenience only and have no legal or limiting effect.

Index of Elements for Handkerchief Holding System (OUST-001)

☐
☐
☐
☐
☐
☐
☐
☐
☐
☐
☐ 10. Handkerchief Holding System
☐ 11.
☐ 12. Handkerchief
☐ 13.
☐ 14.
☐ 15.
☐ 16.
☐ 17.
☐ 18.
☐ 19.
☐ 20. Housing
☐ 21.
☐ 22. Upper End
☐ 23.
☐ 24. Fasteners
☐ 25.
☐ 26. Opening
☐ 27.
☐ 28.
☐ 29.
☐ 30. Clamping Apparatus
☐ 31.
☐ 32. Clamping Members
☐ 33.
☐ 34. Clamps
☐ 35.
☐ 36. Hinges
☐ 37.
☐ 38.
☐ 39.
☐ 40. Biased Perimeter
☐ 41.
☐ 42. Spring
☐ 43.
☐ 44. Securing Loop
☐ 45.
☐ 46.
☐ 47.
☐ 48.
☐ 49.
☐ 50. Shirt
☐ 51.
☐ 52. Breast Pocket
☐ 53.
☐ 54.
☐ 55.
☐ 56.
☐ 57.
☐ 58.
☐ 59.
☐ 60.
☐ 61.
☐ 62.
☐ 63.
☐ 64.
☐ 65.
☐ 66.
☐ 67.
☐ 68.
☐ 69.
☐ 70.
☐ 71.
☐ 72.
☐ 73.
☐ 74.
☐ 75.
☐ 76.

-continued

Index of Elements for Handkerchief Holding System (OUST-001)

☐ 77.
☐ 78.
☐ 79.

The invention claimed is:

1. A handkerchief holding system, comprising:

a housing having at least one wall and an opening, wherein said housing is positionable within a breast pocket of a piece of clothing; and a spring extending about a portion of a perimeter of said housing, wherein said spring forms a U-shaped structure;

wherein said spring is comprised of a coil spring having a plurality of coils to provide more stability and flexibility to said housing.

2. The handkerchief holding system of claim 1, wherein said housing is comprised of a U-shaped structure.

3. The handkerchief holding system of claim 1, wherein said housing has a substantially flat structure.

4. The handkerchief holding system of claim 1, wherein said opening has a closed state and an open state.

5. The handkerchief holding system of claim 1, wherein said housing is frictionally retainable within a breast pocket.

6. The handkerchief holding system of claim 1, wherein said spring is secured within said housing by a securing loop attached to said housing adjacent to said perimeter.

7. The handkerchief holding system of claim 6, wherein said securing loop forms a tubular structure that receives said spring.

8. The handkerchief holding system of claim 1, including a clamping apparatus extending about said opening of said housing, wherein said clamping apparatus is capable of applying a clamping force upon a handkerchief when positioned within a breast pocket.

9. The handkerchief holding system of claim 8, wherein said clamping apparatus includes:

a plurality of clamping members extending about an inside perimeter of said opening; and a plurality of clamps positioned at the ends of said plurality of clamping members wherein said plurality of clamps apply a bias force to said plurality of clamping members to form a substantially linear configuration of said plurality of clamping members.

10. The handkerchief holding system of claim 9, wherein said clamping apparatus includes a plurality of hinges positioned between said plurality of clamps and said housing, wherein a pressure applied simultaneously on said plurality of hinges toward opposite said plurality of hinges overcomes said bias force of said plurality of clamps causing said opening to form an open state.

11. The handkerchief holding system of claim 9, wherein releasing said pressure allows said bias force to return said plurality of clamping members to said substantially linear configuration.

12. A handkerchief holding system, comprising:

a housing having an opening and at least one wall positionable within a breast pocket of a piece of clothing;

wherein said housing is substantially U-shaped having one or more pieces of material positioned in a mirror image fashion and secured together by a plurality of fasteners, thereby forming said at least one wall;

a spring extending around a perimeter of said housing, wherein said spring is secured within said housing by a securing loop having a tubular shape and positioned adjacent to said housing;

wherein said spring is comprised of a coil spring having a plurality of coils to provide more stability and flexibility to said housing;

a clamping apparatus extending about said opening of said housing;

a plurality of clamping members of said clamping apparatus extending about the perimeter of said opening;

a plurality of clamps of said clamping apparatus positioned between said plurality of clamping members wherein said plurality of clamps apply a bias force to said plurality of clamping members to present a substantially linear configuration of said plurality of clamping members and a closed state of said opening;

a plurality of hinges attached to said plurality of clamps and positioned between said plurality of clamps and said housing;

wherein a pressure applied simultaneously on said plurality of hinges toward opposite said plurality of hinges overcomes said bias force causing said opening to form an open state; and wherein releasing said pressure allows said plurality of clamping members to return to said substantially linear configuration and said opening to said closed state.

* * * * *